US007073206B2

(12) United States Patent
Yan

(10) Patent No.: US 7,073,206 B2
(45) Date of Patent: Jul. 11, 2006

(54) CAP WITH UNIQUE RUBBER PIPING

(76) Inventor: Suen Ching Yan, 17145 Margay Ave., Carson, CA (US) 90746

( * ) Notice: Subject to any disclaimer, the term of this patent is extended or adjusted under 35 U.S.C. 154(b) by 224 days.

(21) Appl. No.: 10/703,818

(22) Filed: Nov. 7, 2003

(65) Prior Publication Data

US 2004/0210986 A1 Oct. 28, 2004

Related U.S. Application Data

(63) Continuation-in-part of application No. 10/422,016, filed on Apr. 22, 2003.

(51) Int. Cl.
*A42B 1/04* (2006.01)

(52) U.S. Cl. ..... 2/171; 2/175.1

(58) Field of Classification Search ..... 2/175.1–175.5, 2/195.1–195.6, 171; 223/22
See application file for complete search history.

(56) References Cited

U.S. PATENT DOCUMENTS

| | | | | |
|---|---|---|---|---|
| 1,709,856 | A | 4/1929 | Kleinberg | |
| 2,038,875 | A | 4/1936 | Siegelbaum | 2/178 |
| 2,088,930 | A | 8/1937 | Schwarz | 2/192 |
| D130,160 | S | 10/1941 | Simon | |
| 2,389,388 | A | 11/1945 | Schloss | 112/2 |
| 2,391,046 | A | 12/1945 | Tinnerman | 85/32 |
| 2,678,448 | A * | 5/1954 | Rosenzweig | 2/209.11 |
| 3,869,535 | A | 3/1975 | Coll-Palagos | 264/219 |
| 4,093,694 | A | 6/1978 | Browning | 264/246 |
| 4,606,077 | A | 8/1986 | Phillips | 2/12 |
| 4,914,755 | A | 4/1990 | Motley | 2/185 R |
| 4,964,171 | A | 10/1990 | Landis | 2/9 |
| 5,206,061 | A | 4/1993 | Ando et al. | 428/34.7 |
| 5,553,327 | A | 9/1996 | Koecher et al. | 2/200.3 |
| 5,701,607 | A | 12/1997 | Kaiser | 2/209.13 |
| 5,754,983 | A | 5/1998 | Landers | 2/195.1 |
| 5,765,229 | A | 6/1998 | McLeod et al. | 2/195.1 |
| D419,281 | S | 1/2000 | Croft | D2/891 |
| 6,015,604 | A | 1/2000 | Stahl | 428/195 |
| 6,243,877 | B1 | 6/2001 | Heyward, Jr. | 2/195.1 |
| D452,767 | S | 1/2002 | Balloni et al. | D2/882 |
| 6,370,696 | B1 | 4/2002 | Kronenberger | 2/175.1 |
| 6,449,773 | B1 | 9/2002 | Shwartz et al. | 2/195.1 |
| 6,519,779 | B1 * | 2/2003 | Taguchi | 2/209.12 |
| 6,735,782 | B1 * | 5/2004 | Park | 2/175.5 |
| 2002/0042941 | A1 | 4/2002 | Grundy | 2/195.1 |
| 2004/0194192 | A1 * | 10/2004 | Cho | 2/195.1 |

* cited by examiner

*Primary Examiner*—John J. Calvert
*Assistant Examiner*—Andrew W. Sutton
(74) *Attorney, Agent, or Firm*—Cislo & Thomas, LLP

(57) ABSTRACT

Piping for the crown of a cap and a cap so disposed with piping. The piping is formed into the crown as by attachment to cloth covers, gores, or otherwise. The piping may be made if plastic and may have a logo attached or formed therein as by embossment, engraving, or the like. The piping may enhance the grip upon the hat and may increase the attractiveness and/or appeal of such a hat. Additionally, a logo made of material the same, similar, or different from the crown piping may be used to decorate the cap at its crown or otherwise. The logo may entrap the crown between the logo and backing located inside the crown. The logo may be fastened to the cap by a variety of fasteners including stitching and adhesive.

13 Claims, 3 Drawing Sheets

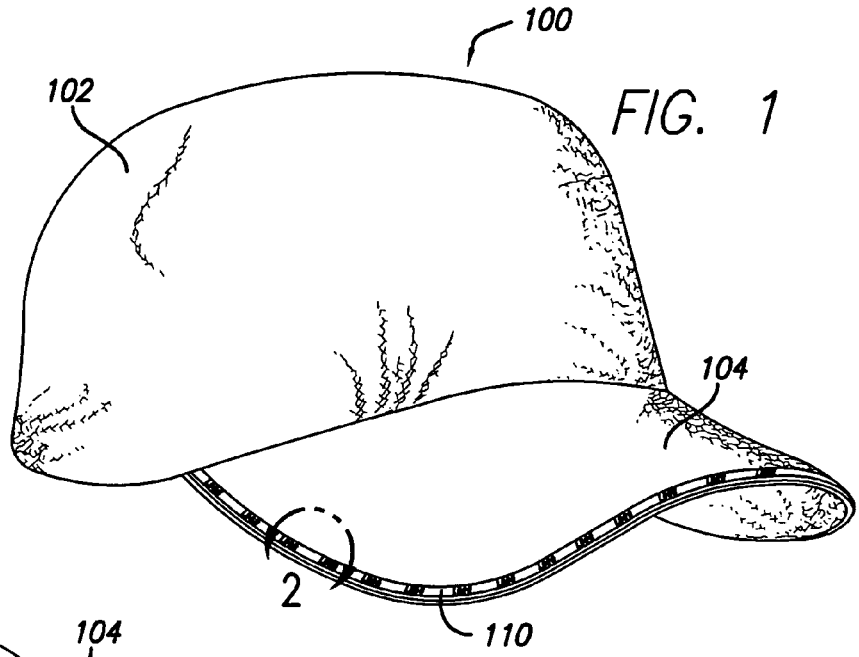
FIG. 1
FIG. 2
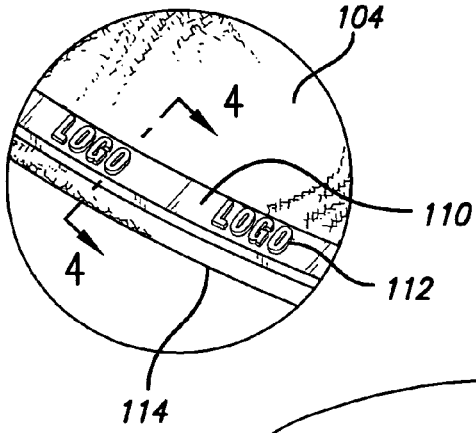
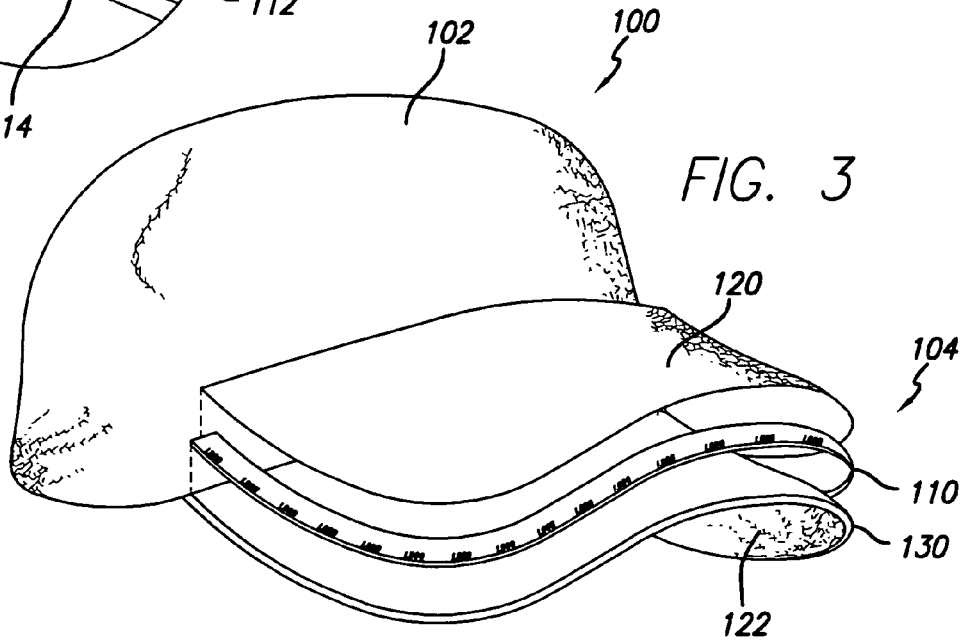
FIG. 3

CAP WITH UNIQUE RUBBER PIPING

CROSS-REFERENCES TO RELATED APPLICATIONS

This patent application is a continuation-in-part of U.S. patent application Ser. No. 10/422,016 filed Apr. 22, 2003 entitled Rubber Piping on Cap Bill Edge which application is incorporated herein by this reference thereto.

COPYRIGHT AUTHORIZATION

Portions of the disclosure of this patent document may contain material which is subject to copyright and/or mask work protection. The copyright and/or mask work owner has no objection to the facsimile reproduction by anyone of the patent document or the patent disclosure, as it appears in the Patent and Trademark Office patent file or records, but otherwise reserves all copyright and/or mask work rights whatsoever.

BACKGROUND OF THE INVENTION

1. Field of the Invention

This invention relates to hats or caps, such as baseball caps, and more particularly to rubber, leather, or other piping that circumscribes at least a part of the perimeter of the crown for such cap, as well as a logo for such a crown.

2. Description of the Related Art

Caps, such as baseball caps, are well known in the art and are often used for recreational purposes. The bowl, crown, or body of the cap provides means by which the head may be covered in order to keep it protected from the sun and the attached bill, brim, or visor stands generally horizontally from the crown in order to provide a shade for the eyes. The baseball cap as a whole is generally made of cloth with optional stiffening material such as cardboard or plastic used to reinforce the bill. The cap may be made in a number of sections and may have a stretchable headband in order to provide elastic engagement for the head of the wearer.

The bill for such caps generally includes a piece of resilient material, such as cardboard or plastic, that is enclosed in cloth or other material to provide a more attractive and uniform appearance, among other things. The entire bill assembly may be stitched to the bowl with its sweatband or headband in order to provide an integrated baseball cap, hat, or other headgear having a bill.

Several attempts have been made previously to complement or augment the bill of a hat, such as a baseball cap. Listed below are several patents and/or publications relevant to the such previous attempts made to achieve such augmentation or decoration. While the descriptions are believed to be accurate, no admission is made by them regarding their subject matter which is solely defined by the patent or reference involved.

| | | | |
|---|---|---|---|
| 6,449,773 | 2002/0042941 A1 | 6,370,696 | Des. 452,767 |
| Des. 419,281 | 6,243,877 | 6,015,604 | 5,765,229 |
| 5,754,983, | 5,206,061 | 4,964,171 | 4,914,755 |
| 5,701,607 | 5,553,327 | 4,606,077 | 4,093,694 |
| 3,869,535 | 2,931,046 | 2,389,388 | Des. 130,160 |
| 2,038,875 | 2,088,930 | 1,709,856 | |

U.S. Pat. No. 1,709,856 discloses a hat and method of making, wherein the hat has a rubberized binding strip sewn to the outer edge of the brim as shown in FIG. 8 (element 20) and page 1, line 110 et seq.

U.S. Pat. No. 2,038,875 discloses a hat having a brim with a channel defined along the brims outer edge wherein a rubber tube is retained within the channel by a binding as shown in FIG. 4 (elements 14 and 16) and column 2, lines 25–46.

U.S. Patent No. 2002/0042941 discloses hat decorations that are designed to fit over the edge of a brim of the hat as shown in FIGS. 2 and 4.

U.S. Pat. No. 5,206,061 discloses a headgear having an opening with an edge containing an elastic material disposed along the edge, wherein the elastic material is a rubber string as shown in column 3, lines 3–7.

U.S. Pat. No. 2,391,046 discloses a reinforcement for a cap visor, wherein the yreinforcement is a decorative stiffener trim mounted along the visor periphery as shown in column 1, lines 27–49.

U.S. Pat. No. 4,606,077 discloses a visor having a bead around the outer periphery of the bill as shown in column 3, lines 63–65.

U.S. Pat. No. 2,088,930 discloses a hat with a layer of vulcanized rubber on its brim as shown in column 1, line 24 et seq.

U.S. Pat. No. 2,389,388 discloses a device and method for stitching hat brims.

U.S. Pat. No. 3,869,535 discloses a method of embossing synthetic material using rollers.

Several patents disclose headwear having bills or visors made of rubber, including: U.S. Pat. No. 5,754,983, U.S. Pat. No. 5,765,229 (column 2, lines 20–27 and column 5, line 59 et seq.), and U.S. Pat. No. 4,964,171 (column 2, lines 42–44).

Some patents disclose headwear having indicia on the bill, including: U.S. Pat. Nos. 6,243,877, 4,914,755, 5,701,607, 6,370,696, 6,449,773, and 5,553,327.

Some patents disclose a method for embossing indicia onto rubber, including: U.S. Pat. No. 4,093,694 (abstract) and U.S. Pat. No. 6,015,604 (column 4, lines 17–28).

Also, attempts have been made in the art to provide ornamentation for caps and hats as reflected by U.S. Design Patent Nos.: Des. 419,281, Des. 452,767, and Des. 130,160.

Baseball caps and the like are often used for convenience and often indicate some disposition, mood, or opinion of the wearer. To this extent, baseball caps are decorated with indicia, logos, and the like. This is particularly true with baseball caps for baseball teams and also include corporate hats that may have corporate logos on them.

Consequently, there is a significant interest in means by which hats or caps can be decorated in an attractive and interesting manner. It would be an advance in the art to provide new means by which such decorations could be achieved in order to provide baseball hats or other hats with bills and/or crowns that are more attractive, more desirable, and fun to wear.

SUMMARY OF THE INVENTION

In view of the foregoing disadvantages inherent in the known types of hats and hat crown decorations now present in the prior art, the present invention provides a new baseball cap having piping circumscribing part of its crown wherein such piping can include logos, indicia, or the like and provide an attractive decoration for the bill of the cap. Additionally, new logo devices may provide unique decoration for the cap's crown, bill, or other structure.

The general purpose of the present invention, which will be described subsequently in greater detail, is to provide piping for the crown of a baseball cap which has many advantages of previous baseball cap crowns and decorations therefor, and many normal features that result in a new and attractive decoration for baseball caps as well as a possibly-useful grip-enhancing device which is not anticipated, rendered obvious, suggested, taught, or even implied in the prior art baseball caps or hats, either alone or in any combination thereof.

Piping in the form of leather, rubber, or other material is non-releasably coupled or attached to the crown of the cap by means of adhesion, stitching, the use of cloth covers, or the like. The piping itself generally has a flat base that extends rearwardly from a forward projection that projects upwardly from the base. The piping can be made of plastic, leather, or other materials. The piping can also be attached to the cloth cover that enshrouds or composes the crown in a manner where the piping follows the upper or outer exterior of the crown. Stitching may also be used to attach the piping to the crown.

The piping may be manufactured by providing a rubber, elastic, or flexible material. In addition, indicia deposited upon the face of the piping may be in melted rubber form and deposited on to the rubber or other strip comprising the base of the piping. After deposition of the melted material or otherwise, such indicia material is immediately cooled with cooling gas or otherwise and thereafter formed onto or into the bill edge in order to provide the piping set forth herein.

The piping may follow the curvature of the crown as it descends to the top much in the manner of the seams between the separate, often-present gores that may compose the crown of the cap. A logo or the like may be attached to the crown or elsewhere on the cap and may generally share similar characteristics to the piping with respect to construction and attachment of the logo to the cap. In order to better secure the logo to the cap, backing may be used in order to secure any stitching or other attachment means to the cap and prevent such attachments means from pulling through the crown material or otherwise allowing the logo to detach itself from the crown.

In one embodiment, a baseball cap has a crown with one or more gores with a bill attached to the crown. Embossable piping is coupled to the crown, the piping also being at least partially exposed and visible, and having a flat base portion extending rearwardly and coupled to the crown. The piping has an upwardly projecting portion coupled to and projecting away from the flat base portion, the upwardly projecting portion being at least partially visible from outside the cap. A first embossed indicia is coupled to the upwardly projecting portion so that the first indicia is visible from outside the cap. A first gore may be coupled to a top side of the piping and a second gore may be coupled to a bottom side of the piping.

The first and second gores may coupled to the piping in a variety of ways, including (but not limited to): the first and second gores adhesively attached to the piping, the first and second gores stitchedly attached to the piping, and the first and second gores stitchedly attached to the piping then doubled back to protect exposed edges of the first and second gores.

An embossable logo may be coupled to the crown and be at least partially exposed and visible from outside the cap. A separate embossed indicia may be coupled to the logo so that the logo indicia is visible from outside the cap. Two gores may be coupled to a bottom side of the logo. The two gores may be coupled to the logo in a variety of ways, including (but not limited to): adhesively attached to the logo and stitchedly attached to the logo.

Lastly, a backing may be applied to an inside of the crown to entrap the crown between the backing and the logo.

In one embodiment of a method consistent with the present system, a method for decorating a cap is set forth. In the method, a baseball cap crown having gores is provided and a baseball cap bill is attached to the crown. Embossable piping is attached to the crown, the piping coupled to the crown and being partially exposed and visible. The piping may have a flat base portion extending rearwardly and coupled to the crown. The piping may have an upwardly projecting portion coupled to and projecting away from the flat base portion, the upwardly projecting portion being at least partially visible from outside the cap.

Embossed indicia is applied to the piping by laying on melted material on the piping, the melted material in form of the piping indicia. The melted material is then cooled to set the piping indicia. A first gore may be coupled to a top side of the piping and a second gore may be coupled to a bottom side of the piping. The coupling of the first and second gores to the piping may be achieved in a variety of manners, including (but not limited to): adhesively attaching the first and second gores to the piping, stitchedly attaching the first and second gores to the piping, and the first and second gores stitchedly attached to the piping then doubled back to protect exposed edges of the first and second gores.

An embossable logo may be attached to the crown, the logo coupled to the crown and being partially exposed and visible from outside the cap. Embossed indicia may be separately applied to the logo by laying on melted material on the logo, the melted material in form of the desired indicia. The melted material may be cooled to set the second indicia.

Two gores may be coupled to a bottom side of the logo. The coupling of the two gores to the logo may be achieved in a variety of manners, including (but not limited to): adhesively attaching the gores to the logo and stitchedly attaching the gores to the logo. Lastly, a backing may be applied to an inside of the crown to entrap the third and fourth gores between the backing and the logo.

OBJECTS OF THE INVENTION

It is an object of the present invention to provide decoration for hats, baseball caps, and the like.

It is another object of the present invention to provide decorative piping for the crown of a baseball cap.

It is yet another object of the present invention to provide decorative piping for the crown of a baseball cap, such piping including indicia, logos, lettering, or the like.

It is yet another object of the present invention to provide decorative piping for the seams between gores in the crown of a baseball cap.

It is yet another object of the present invention to provide a decorative logo that may display indicia, the logo being attachable to a cap.

It is yet another object of the present invention to provide a decorative logo capable of displaying indicia upon the logo.

These and other objects and advantages of the present invention will be apparent from a review of the following specification and accompanying drawings. The foregoing objects are some of but a few of the goals sought to be attained by the present invention.

BRIEF DESCRIPTION OF THE DRAWINGS

FIG. 1 is a right side front perspective view of a baseball cap having the piping circumscribing the bill as set forth herein.

FIG. 2 is an enlarged portion of a part of the piping shown in FIG. 1 along circle 2.

FIG. 3 is a right front perspective view of the baseball cap shown in FIG. 1 with the piping, the bill portion of the baseball cap being shown in exploded view.

DESCRIPTION OF THE PREFERRED EMBODIMENT(S)

Figure 4:
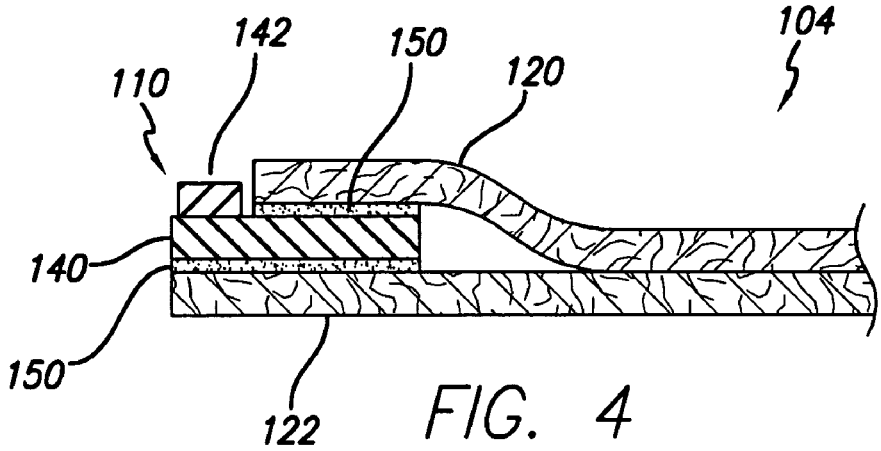
FIG. 4 is a cross sectional view taken along line 4—4 of FIG. 2.

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Referring to the drawings where like numerals of reference designate like elements throughout it will be noted that the hat 100 shown in FIG. 1 is a hat of typical baseball cap-like construction having a bowl, crown, or cap portion 102 to which a bill, brim or visor 104 is attached. The bill 104 extends out generally horizontally from the base of the bowl 102 and serves as a shade for the eyes of a wearer (not shown) of the cap 100.

Circumscribing the bill 104 is piping 110. The piping generally circumscribes the exterior perimeter of the bill 104 along its upper edge or top. FIG. 2 shows an enlarged view of a portion of the piping shown in FIG. 1. As indicated in FIG. 2, the piping 110 may carry a logo 112 or the like in order to provide additional enhancements to the piping 110. The piping 110 may be flush with the edge of the bill 114 or may be slightly offset from it as shown in FIG. 2.

FIG. 3 shows an exploded view of the bill portion of the hat 100. The bill 104 has a top cloth cover 120 and a bottom cloth cover 122. The top and bottom cloth covers 120, 122 are cut in form fitting fashion so that they fit closely with the stiffener 130 and serve to provide an attractive cloth cover of any desired color or texture that may complement or offset the color, texture, and fabric of the bowl 102. The piping 110 is generally trapped or held between the top cloth cover 120 and the stiffener 130 in a fashion such that the piping 100 does not move with respect to the bill 104. Other means of attaching or embedding the piping 110 to the bill 104 may also be used. Such fixing of the piping 100 is shown in cross section in FIGS. 4–6 in alternative embodiments. These views correspond to a view taken along line 4—4 in FIG. 2.

Especially in conjunction with the piping 110 shown in FIG. 3, FIG. 4 shows that the piping 110 has an inwardly extending base 140 which at its forward end terminates in an upward projection 142. The piping base 140 forms a foundation for the engagement of the piping 100 by the bill 104 through one or more of the top cloth cover 120, the stiffener 130, or the bottom cloth cover 122. Although not shown in FIG. 4, the stiffener 130 may be present in the bill 104 as part of the bottom cloth cover 122, may be offset from the piping 110 so as not to be present in FIG. 4, or may be absent entirely from the bill 104.

In FIG. 4, the top cloth cover 120 is shown adhesively attached to a top portion of the base 140 with the forward section and top projection 142 with the piping 110 left exposed and visible. The bottom cloth cover 122 is likewise adhesively attached by an adhesive 150 to the bottom of the base 140 and the piping 110. The same or a similar adhesive 150 may be used to attach the top cloth cover to the top of the base 140.

When the piping 100 is so engaged by the top cloth cover 120 and the bottom cloth cover 122 as shown in FIG. 4, the stiffener 130 may be inserted into the envelope created by the attachment of the top and bottom cloth covers 120, 122 by the piping 110. The stiffener 130 and the top and bottom cloth covers 120, 122 established the bill 104 and are then attached to the bowl 122 with stitching or the like in a fashion that generally exerts some tension on the stiffener 130. The stiffener 130 may have the additional feature of holding the top and bottom cloth covers 120, 122 in place as well as the piping 110.

Figure 5:
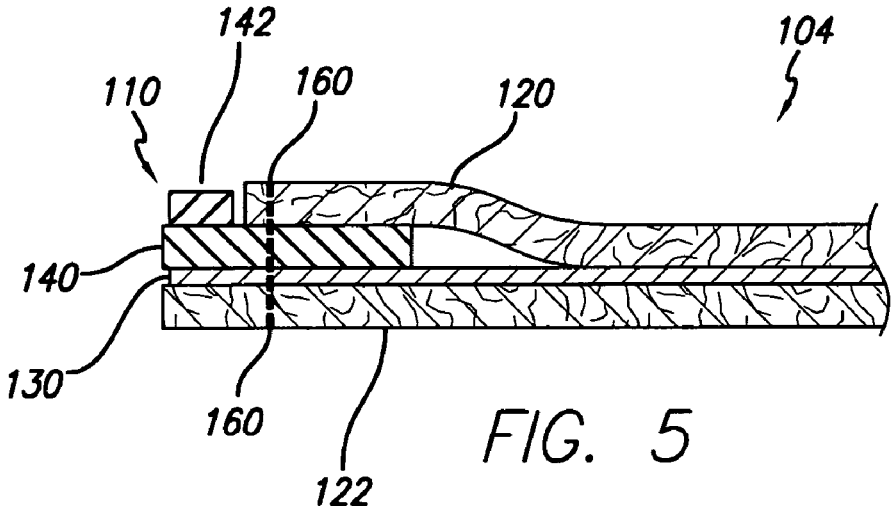
FIG. 5 is an alternative embodiment of the cross section shown in FIG. 4.

Alternatively, as is shown in FIG. 5, stitching 160 may be used to attach the top and bottom cloth covers 120, 122 as well as the stiffener 130 to the piping 110 in a manner similar to that shown in FIG. 4 which leaves the top projection 142 of the piping 110 as well as the front of the piping 110 exposed and visible.

Figure 6:
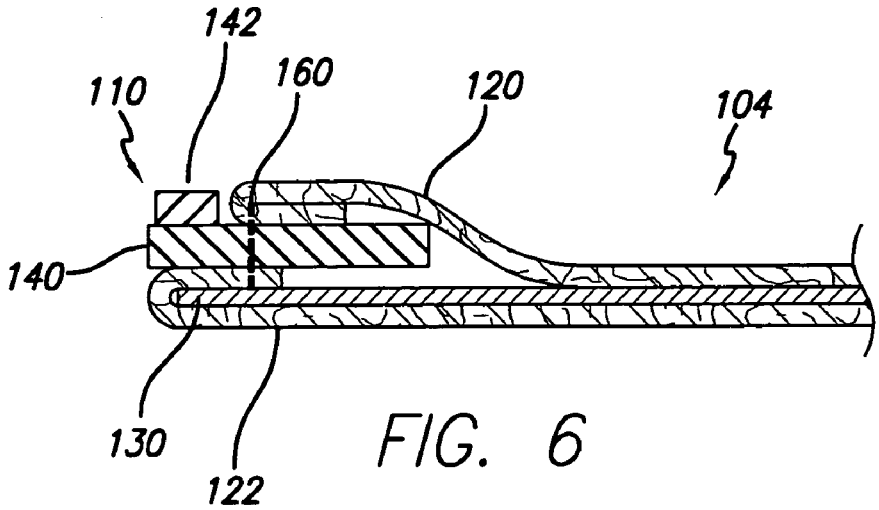
FIG. 6 is another alternative embodiment of the cross section shown in FIG. 4.

Alternatively, FIG. 6 portrays an additional embodiment where the top cloth cover 120 and bottom cloth cover 122 can be independently or coordinatingly stitched to the piping 110. When so independently stitched to the piping 110, the top and bottom cloth covers can be so attached in a manner where the cloth covers 120, 122 are folded back upon themselves so as to form a generally narrow doubled-back layer on either side of the piping 110.

Initially, the cloth covers 120, 122 are stitchedly attached near one edge to opposite sides of the piping 110. The major portion of the cloth covers 120, 122 then temporarily extend over and past the upward projection 142. In such a situation, the base 140 of the piping 110 with its rearward projection could be, for the temporary purposes of describing this attachment, considered to be the forward portion of the piping 110. A margin of fabric for both the top and bottom cloth covers 120, 122 is then provided there which is forward of the stitching that attaches the top and bottom cloth covers 120, 122 to the piping 110. This leaves a cloth envelope with the top projection 142 of the piping 110 covered by the inside of such a cloth envelope. This cloth envelope is then turned inside out so that the fabric doubles back upon the previously-forward margin and the stiffener 130 may be inserted into this envelope beneath the base 140 so as to provide the bill 104 shown in FIG. 1.

Other means may also be used by which the piping 110 may be attached either directly to the stiffener 130, the top cloth cover 120, the bottom cloth cover 122 or any combination thereof.

One advantage to using rubber or the like with a logo 112 is that the piping 110 actually provides a convenient means by which to keep a grip on the cap 100 by engaging its bill 104. The base 140 of the piping 110 is then present underneath the top cloth cover 120 and is tactilely discernible when grasping the edge of the brim 104. The exposed projection 142 or other area of the piping 110 also provides means that enhance the grip and engageability of the hat 100. This is particularly true when a logo 112 is present along the projection 142 as it provides additional means by which a grip can be better established and maintained on the bill 104.

As indicated above, the piping 110 can be made of a variety of different substances and materials including plastic, leather, and the like. Generally, the piping 110 is a prefabricated strip of such material and the logo 112 may be deposited by the careful application of melted rubber or the like, stitching (as in the case of leather) or otherwise, generally prior to the incorporation of the piping 110 into the bill 104.

Where melted rubber is deposited as on a plastic or rubber piping strip 110, it may be immediately cooled with cooling gas and there after formed into the bill edge as indicated above. The resulting piping 110 with indicia 112 may thereafter be formed onto or into the bill edge in order to provide the piping set forth herein. Other series of steps may be used such as adding the indicia after the piping 110 is coupled to the bill 104. However, it is currently contemplated that such addition of indicia 112 after attachment of the piping 110 to the bill 104 may present problems during manufacture. The piping 110 and any logo 112 may be the same or different colors depending upon the preferences of the manufacturer or consumer.

Beyond the additional gripping enhancements that the piping provides to the hat 100, any logo 112 may serve to enhance the attractiveness or appeal of the cap as by adding the name of a popular celebrity, products (for hats used as advertisements), sayings or quotations, designs, or any other printed matter that fits sufficiently on the projection 142 of the piping 110.

As shown in FIGS. 7–10, piping may also be added to the crown 102 of the hat 100. Individual gores 170 generally form the crown 102 of the hat 100. The gores 170 generally terminate at the top in a button 172 from which the crown piping 174 may travel to the base 176 of the crown 102. The crown piping 174 may generally travel along seams 178 present between the gores 170. The crown piping 174 may be much the same or exactly the same as the piping 100 circumscribing the edge 114 of the bill 104 as shown in other Figures.

The logo 180 may sit astride an intergore seam 178 and may be attached to the crown 102 by such stitching 160 similar to that described previously and as shown in the other Figures.

The logo 180 may be made of material similar to that of the piping 110, 174 with indicia present on the logo 180 to the extent desired and applied in a manner similar to that with respect to logos and indicia applied to the piping 110, 174.

Figure 7:
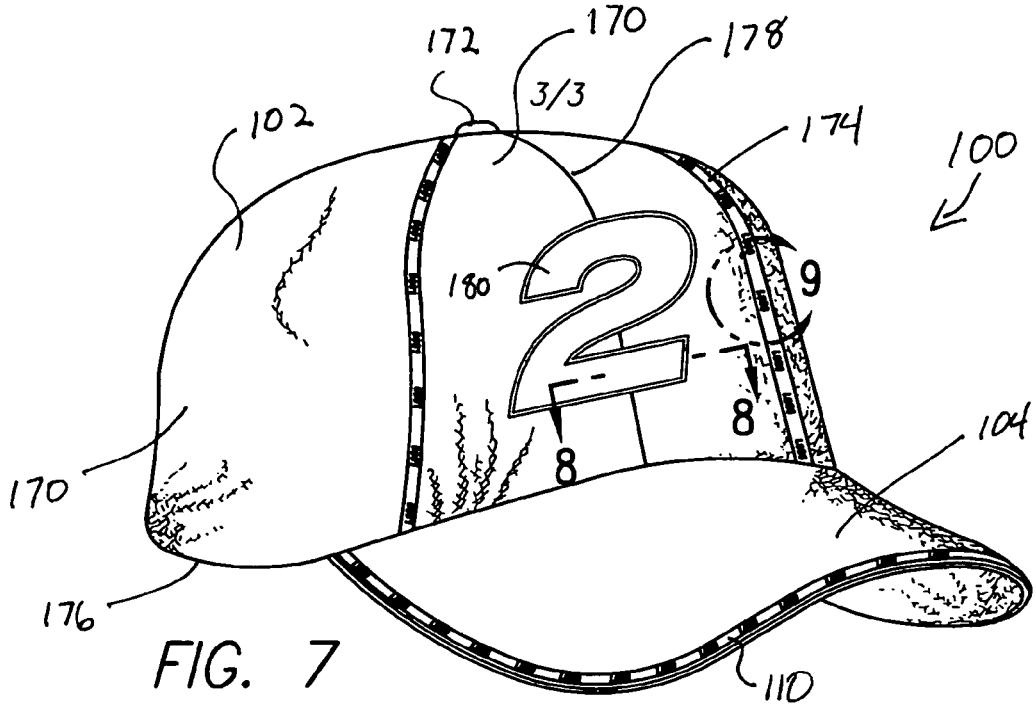
FIG. 7 is a right side perspective view of a cap having crown piping and a logo.
Figure 8:
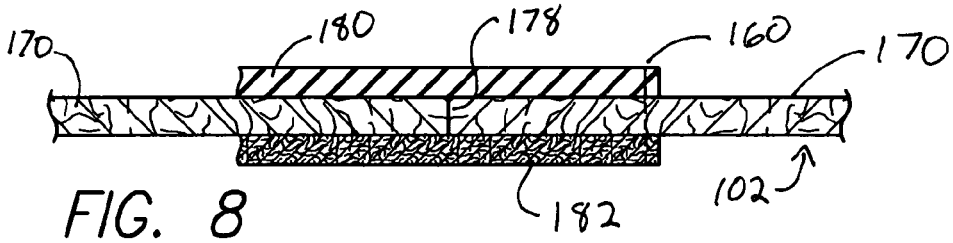
FIG. 8 is a cross sectional view of a logo, crown and backing of the cap shown in FIG. 7 taken along line 8—8 of FIG. 7.

FIG. 8 shows in cross section a portion of the logo 180 shown in FIG. 7. The portrayal of the logo 180 is generally taken along the line 8–8 of FIG. 7 and shows side stitching 160. The stitching 160 may pass through the logo 180, the crown 102 and backing 182 in order to attach the logo 180 to the crown 102. The backing 182 serves as means by which the stitching 160 can be held firmly in conjunction with the logo 180 and the crown 102 or otherwise. The fabric of the crown 102 may be soft and may be subject to tearing or possibly allow pull through of the stitching 160 such that the logo 180 could become loose as the stitching 160 made detach from the crown 102. The backing 182 may be of stronger and preferably thinner material that forms a strong foundation to which the stitching 160 may attach. A thin sheet of poly-paraphenylene terephthalamide (Kevlar®) or similarly- or sufficiently-performing material that can be perforated in the stitching process in order to engage the threads of the stitching 160 is one example of the type of material that could be used for the backing 182. However, less expensive material such as resilient plastic or polyethylene might be used. Polyesters and or polyethylenes such as Mylar® may make a good material from which the backing 102 may be constructed.

As indicated in FIGS. 7 and 8, the logo 180 may sit astride the seam 178 between two gores 170. This is generally consistent with current construction of baseball caps and the like. As a result, the attachment of the logo 180 to the crown 102 may serve to also hold the seam 178 together although the seam 178 should be able to be held together on its own without the help of the logo 180. Other approaches to the attachment of the logo 180 to the crown 102 may be used including adhesives and other fasteners. The logo 180 is generally not removable from the cap 100 although the logo 180 set forth herein is generally independent of the cap to which it is attached, much like the construction of the piping 110, 174 which is generally not dependent upon the hat 100 to which it is attached.

Figure 9:
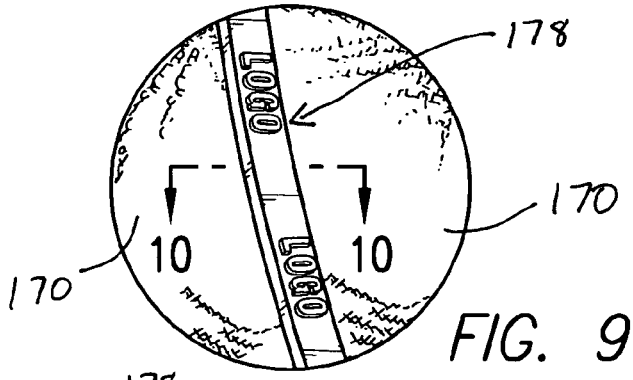
FIG. 9 is a close up view of the crown piping as indicated by circle 9 of FIG. 7.

FIG. 9 shows a close up of the crown piping 174. FIG. 9 is similar to that of FIG. 2 and the piping 174 used for the crown 170 may be similar to the piping 110 used for the bill or brim 104. The crown piping 174 may be similar in construction to that of the bill piping 110 and FIG. 10 may be mechanically similar to the structure shown in FIG. 4. In fact, in at least one embodiment, the disclosure set forth herein with respect to the bill piping 110 may be applied to the crown piping 174.

The crown piping 174 has a piping base 140 and a piping projection 142 in a manner similar to that for the bill piping 110. Adhesive 150 may be used to attach the adjacent gores 170 to one another by means of the crown piping 174. However, in contrast to the configuration shown in FIG. 4, instead of the lower gore 170 proceeding parallel and adjacent to the top gore 170, the lower gore 170 travels away from the crown piping 174. In FIG. 4, the bottom cloth cover 122 travels in the same direction as the top cloth cover 120 as this is required by the configuration needed for the bill 104. As the gores 170 generally provide the cover needed for the person's head, and as there is no stiffener 130 generally used in conjunction with the crown 102, the two gores 170 are set in a fixed side-by-side manner to provide the crown 102.

Figure 10:
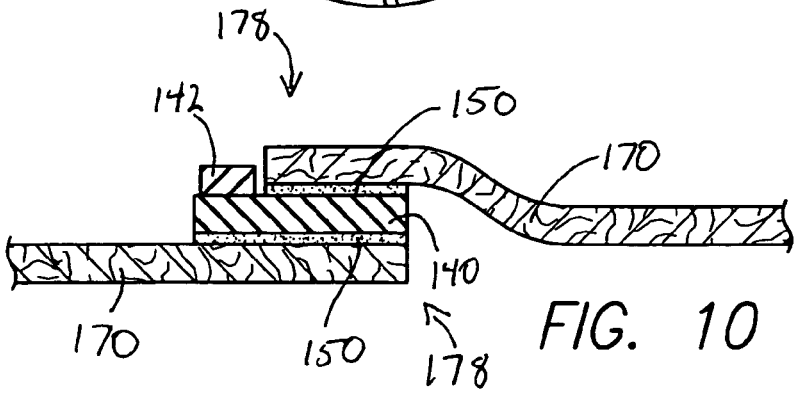
FIG. 10 is a cross sectional view of the crown piping of FIG. 9 taken along line 10—10 of FIG. 9.

The coupling of the two gores 170 at the crown piping 172 define a seam 178. While the seam 178 may be reinforced or entirely established by stitching or the like, FIG. 10 shows one embodiment of the crown piping system where an adhesive 150 is used to couple the two gores 170. Other means of attachment, such as those set forth above with respect to the bill piping 110, may also be used to good advantage with respect to the gore seams 178 of the crown 102.

Moreover, as the crown piping 174 and the logo 180 are made of generally the same material as the bill piping 110, the disclosure set forth above with respect to the bill piping 110, its construction, and its attachment to different hat portions and structures are generally applicable to both the crown piping 174 and the logo 180. In an alternative embodiment, the backing 182 may be one having multiple layers (not shown) in order to provide better performance or otherwise.

The logo may be positioned at the front center of the crown 102 as is generally well known for baseball caps and the like. However, other locations may be used for disposition of the logo 180 including the rear and/or sides of the cap as well as the bill. Along these lines, the piping 174 for the crown 120 may be located along seams 178 or elsewhere and may circumscribe the cap in a circular manner centered upon the top button 172, may serve as stripes running along the height of the cap along the seams 178, or otherwise, only limited by the imagination of the cap designer. With respect to the backing, the backing should be located on the side of the crown opposite that of the logo 180, so that the backing 182 is on the side of the crown 102 opposite that of the logo 180.

While the present invention has been described with regards to particular embodiments, it is recognized that additional variations of the present invention may be devised without departing from the inventive concept.

What is claimed is:

1. A cap with a crown, comprising:

embossable piping, said piping coupled to the crown, said piping also being partially exposed and visible;

a first crown portion coupled to a top side of said piping; and a second crown portion coupled to a bottom side of said piping.

2. A cap with a crown as set forth in claim 1, the crown further comprising:

said first and second portions of the crown coupled to said piping in a manner selected from the group consisting of:

said first and second portions adhesively attached to said piping;

said first and second portions stitchedly attached to said piping; and said first and second portions stitchedly attached to said piping then doubled back to protect exposed edges of said top and bottom covers.

3. A cap with a crown as set forth in claim 1, the crown further comprising:

said first crown portion being a first gore; and said second crown portion being a second gore.

4. A cap with a crown as set forth in claim 1, further comprising:

a bill attached to the crown.

5. A baseball cap with a crown, comprising:

embossable piping, said piping coupled to the crown, said piping also being partially exposed and visible, said piping having a flat base portion extending rearwardly and coupled to the crown and said piping having an upwardly projecting portion coupled to and projecting away from said flat base portion, said upwardly projecting portion being at least partially visible from outside the cap;

embossed indicia, said indicia coupled to said upwardly projecting portion whereby said indicia is visible from outside the cap;

a first crown portion coupled to a top side of said piping; and a second crown portion coupled to a bottom side of said piping.

6. A baseball cap with a crown as set forth in claim 5, said crown further comprising:

said first and second portions of the crown being respectively first and second gores coupled to said piping in a manner selected from the group consisting of:

said first and second gores adhesively attached to said piping;

said first and second gores stitchedly attached to said piping; and said first and second gores stitchedly attached to said piping then doubled back to protect exposed edges of said first and second gores.

7. A baseball cap with a crown as set forth in claim 5, further comprising:

a bill attached to said crown.

8. A crown for a cap, comprising:

embossable piping, said piping coupled to said crown, said piping also being partially exposed and visible;

a first crown portion coupled to a top side of said piping; and a second crown portion coupled to a bottom side of said piping.

9. A crown for a cap as set forth in claim 8, said crown further comprising:

said first and second crown portions coupled to said piping in a manner selected from the group consisting of:

said first and second crown portions adhesively attached to said piping;

said first and second crown portions stitchedly attached to said piping; and said first and second crown portions stitchedly attached to said piping then doubled back to protect exposed edges of said first and second crown portions.

10. A crown for a cap as set forth in claim 9, said crown further comprising:

said first crown portion being a first gore; and said second crown portion being a second gore.

11. A baseball cap-type crown for a cap, comprising:

embossable piping, said piping coupled to the crown, said piping also being partially exposed and visible, said piping having a flat base portion extending rearwardly and coupled to the crown and said piping having an upwardly projecting portion coupled to and projecting away from said flat base portion, said upwardly projecting portion being at least partially visible from outside said crown;

embossed indicia, said indicia coupled to said upwardly projecting portion whereby said indicia is visible from outside said crown;

a first crown portion coupled to a top side of said piping; and a second crown portion coupled to a bottom side of said piping.

12. A baseball cap-type crown for a cap as set forth in claim 11, said crown further comprising:

said first and second crown portions coupled to said piping in a manner selected from the group consisting of:

said first and second crown portions adhesively attached to said piping;

said first and second crown portions stitchedly attached to said piping; and said first and second crown portions stitchedly attached to said piping then doubled back to protect exposed edges of said first and second crown portions.

13. A baseball cap-type crown for a cap as set forth in claim 12, said crown further comprising:

said first crown portion being a first gore; and said second crown portion being a second gore.

* * * * *